United States Patent [19]

Vaughan, Jr.

[11] 4,271,732

[45] Jun. 9, 1981

[54] CAM-OPERATING ADJUSTABLE PLIER WRENCH WITH OVERTRAVEL STOP DEVICE

[76] Inventor: James E. Vaughan, Jr., 248 Fisher Rd., North Dartmouth, Mass. 02747

[21] Appl. No.: 54,284

[22] Filed: Jul. 2, 1979

[51] Int. Cl.[3] ..... B25B 7/04

[52] U.S. Cl. ..... 81/414

[58] Field of Search ..... 81/406–444, 81/393, 446, 415; 30/271

[56] References Cited

U.S. PATENT DOCUMENTS

| | | | |
|---|---|---|---|
| 844,886 | 2/1907 | Morris | 81/407 |
| 1,041,353 | 10/1912 | Rouse et al. | 81/407 |
| 1,101,181 | 6/1914 | Hayden | 81/415 |
| 2,592,927 | 4/1952 | Manning | 81/414 |

FOREIGN PATENT DOCUMENTS

| | | | |
|---|---|---|---|
| 844128 | 7/1952 | Fed. Rep. of Germany | 81/407 |

*Primary Examiner*—James L. Jones, Jr.
*Attorney, Agent, or Firm*—Barlow & Barlow

[57] ABSTRACT

An adjustable cam-operated jaw plier wrench fitted with an integral, handle-mounted overtravel stop member is described. The integral overtravel stop member is permanently affixed to one of the two jaw-handle portions of the plier wrench. In operation, the fixed overtravel stop member's outer surface abuts the opposite jaw-handle member edge surface, thereby preventing handle overtravel along with its usual attendant injury to the hand of the operator during normal use of the tool. The position of the integral overtravel stop member will allow ready adjustment of the jaw plier wrench to any of its preset adjustable positions.

1 Claim, 5 Drawing Figures

CAM-OPERATING ADJUSTABLE PLIER WRENCH WITH OVERTRAVEL STOP DEVICE

BACKGROUND OF THE INVENTION

This invention relates to adjustable jaw type plier wrenches, wherein the jaws may be readily adjusted to any of several preset positions, and more particularly, to improvements in the structure of jaw type plier wrenches, resulting in the safer operation of plier wrenches by preventing injury to the hand of the operator from overtravel of the oppositely-mounted handles during normal use of the tool.

Adjustable jaw type plier wrenches commonly available comprise a pair of crossed jaw-handle members that are pivoted at a fixed offset point. There is ordinarily no common provision supplied to protect the operator's hand from a crushing injury during the process of gripping and manipulating of the workpiece in the jaws of such an adjustable plier wrench. There is no means to limit the inward travel of the jaw-handle members of the prior art plier wrenches of the adjustable jaw type. This absence of an inward overtravel stop member has resulted in numerous crushing injuries to the hand of the operator while using this type of adjustable cam-operating jaw type plier wrenches.

Stops broadly in single pivoted tongs are shown in some prior art such, for example, as in U.S. Pat. Nos. 1,041,353 and 1,101,181 but their location between the handles may interfere with proper manipulation of the tool.

SUMMARY OF THE INVENTION

The adjustable jaw type plier wrench of the present invention overcomes the disadvantages of the prior art. The jaw-handle member of the present invention that is provided with a fixed pin to act as the central pivot point for the opposite jaw-handle members is also provided with an integral raised overtravel stop member, which is oriented towards the opposite jaw. This arrangement and positioning of the integral raised overtravel stop member functions such that the oppositely opposed handles are prevented from overtravel during their inward movement, thereby eliminating the danger of a crushing injury to the operator's hand during the use of the tool. The shape and positioning of the integral raised overtravel stop member fully allows for the manual adjustment of the bearing socket and teeth mechanism to its intermediate as well as extreme preset positions during normal use.

Other objects and advantages will become apparent from the following specification taken in connection with the accompanying drawings.

DESCRIPTION OF THE DRAWING

The character of the invention, however, may best be understood by reference to one of its structural forms, as illustrated by the accompanying drawing, in which.

DESCRIPTION OF THE PREFERRED EMBODIMENT

Figure 1:
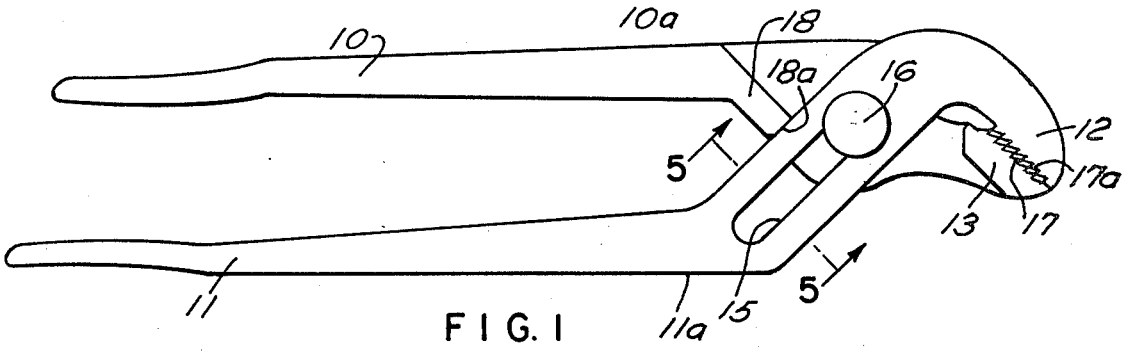
FIG. 1 is a top plan view of the adjustable jaw plier wrench of the present invention, showing the jaw-handle members in the closed position.
Figure 4:
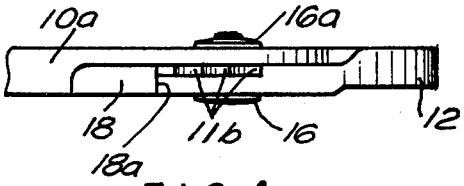
FIG. 4 is an edge view of the adjustable jaw plier wrench of the present invention looking at the lower edge of FIG. 2, illustrating the handle-mounted overtravel stop member.
Figure 2:
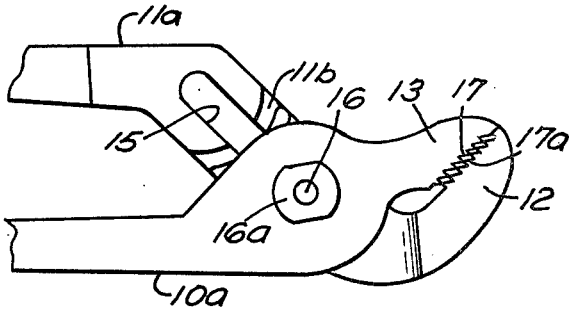
FIG. 2 is a bottom plan view of the operable section (minus handles) of the adjustable jaw plier wrench of the present invention, showing the jaw-handle members in the closed position.
Figure 3:
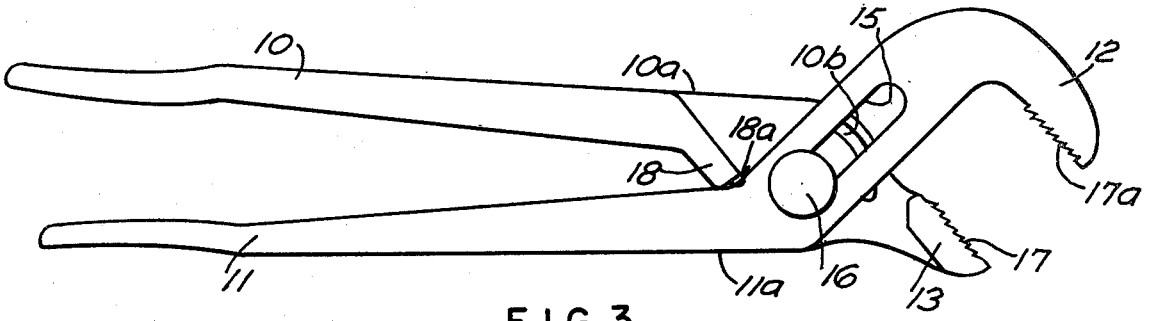
FIG. 3 is a top plan view of the adjustable jaw plier wrench of the present invention, showing the jaw-handle members in the extreme extended position.
Figure 5:
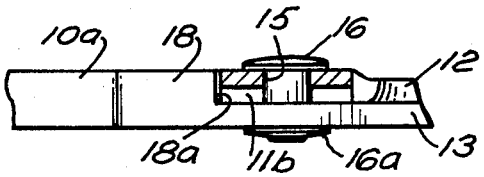
FIG. 5 is a slightly enlarged cross-sectional view of the adjustable jaw plier wrench of the present invention taken along lines 5—5 of FIG. 1, and illustrating the handle-mounted overtravel stop member.

Referring now to the drawing, there is shown an adjustable jaw type plier wrench according to the present invention. The plier wrench includes a first handle 10 and a second handle 11. The first handle 10 is integrally connected to a first jaw member 13, while the second handle 11 is integrally connected in a similar fashion to a second jaw member 12. The first jaw member 13 with its attached first handle 10 is here considered to be the first jaw-handle member 10*a*. Likewise, the second jaw member 12 with its attached second handle 11 is to be considered as the second jaw-handle member 11*a*.

The first jaw-handle member 10*a* and the second jaw-handle member 11*a* are loosely pivoted together by means of pivot bolt 16. Pivot bolt 16 is secured in its position by means of pivot nut 16*a*.

Both first jaw 13, as well as second jaw 12, have oppositely oriented exposed faces 17 and 17*a* respectively, that may be serrated, aiding in the secure gripping of the workpiece. The region connecting the second handle member 11 with its associated second jaw member 12 defines an area containing an essentially elongated, rectangularly-shaped channel 15. This channel 15, in combination with the pivot bolt 16, serves to permit discrete adjustments to be made of the pivotally-mounted jaw-handle members 10*a* and 11*a*. To this end, member 10*a* has a tooth 10*b* while member 11*a* has a plurality of spaced bearing sockets 11*b* into which tooth 10*b* may engage. The adjustment of the jaw-handle members 10*a* and 11*a* to discrete open positions is accomplished by first rotating counter clockwise the top-mounted second jaw-handle member 11*a* to a position essentially perpendicular to the bottom-mounted first jaw-handle member 10*a*. The top-mounted second jaw-handle member 11*a*, containing channel 15, is then slid perpendicularly to an open position to the bottom-mounted jaw-handle member 10*a*, being guided past pivot bolt 16 in the process. The top-mounted jaw-handle member 11*a* is then rotated clockwise to its previous position with the handles 10 and 11 being parallel. This parallel position of the handle- 10 and 11 is reached following the completion of the inward travel of second handle 11 by the abutting of jaw-handle member 11*a* against the outer exposed surface 18*a* of the raised integral overtravel stop member 18. The overtravel stop member 18 is essentially a rectangular elongated raised member integral to the first jaw-handle member 10*a* and arising at the region of the first handle 10 closest to the connecting region of the first jaw-handle member 10*a*. This stop member 18 primary function is to prevent overtravel of second handle 11 in its movement toward a first handle 10, thereby preventing a crushing injury to the hand of the operator during the use of the tool.

It is to be further noted that the positioning of the overtravel stop member 18 allows ready adjustment of the jaw plier wrench to any of its present positions.

It is obvious that minor changes may be made in the form and construction of the invention without departing from the material spirit thereof. It is not, however, desired to confine the invention to the exact form herein shown and described, but it is desired to include all such as properly come within the scope claimed.

I claim:

1. An adjustable jaw plier wrench comprising:

a first handle means, a first jaw means connected to said first handle means, a second handle means, a second jaw means connected to said second handle means, a pivot pin means carried by said first jaw means, an adjustable arcuate tooth and socket means incorporated within the jaw means, spaced from and concentric with the pivot pin means, said second jaw means having a substantially rectangular portion extending at right angles to the jaw, said portion joining said jaw and handle means, said portion having a slot receiving said pivot pin for adjusting said tooth and socket means, an overtravel stop member integrally mounted onto said first handle means on the portion thereof remote from the jaw and pivot pin to limit overtravel of said tooth in said socket of said second handle means during pivotal movement of said handles and jaws about said pivot pin, said stop member engaging the edge of said rectangular portion from the closed jaw position to fully open jaw position as said jaws are adjusted.

* * * * *